US006633131B2

(12) United States Patent
Murao et al.

(10) Patent No.: US 6,633,131 B2
(45) Date of Patent: Oct. 14, 2003

(54) MAGNETRON

(75) Inventors: Noriyuki Murao, Hyogo-ken (JP); Kazuki Miki, Himeji (JP); Setsuo Hasegawa, Kasai (JP); Noriyuki Okada, Hyogo-ken (JP); Satoshi Nakai, Kasai (JP)

(73) Assignee: Sanyo Electric Co., Ltd., Osaka (JP)

( * ) Notice: Subject to any disclaimer, the term of this patent is extended or adjusted under 35 U.S.C. 154(b) by 198 days.

(21) Appl. No.: 09/924,386

(22) Filed: Aug. 8, 2001

(65) Prior Publication Data

US 2002/0070108 A1 Jun. 13, 2002

(30) Foreign Application Priority Data

Aug. 10, 2000 (JP) ..... 2000-241947

(51) Int. Cl.[7] ..... H01J 25/50
(52) U.S. Cl. ..... 315/39.51; 315/39.67
(58) Field of Search ..... 315/39.51, 39.53, 315/39.67; 313/34, 36, 37

(56) References Cited

U.S. PATENT DOCUMENTS

| | | | | | |
|---|---|---|---|---|---|
| 5,021,713 | A | * | 6/1991 | Uesawa et al. | 315/39.51 |
| 5,294,864 | A | * | 3/1994 | Do | 315/39.51 |
| 5,508,583 | A | * | 4/1996 | Lee | 313/446 |
| 5,604,405 | A | * | 2/1997 | Ogura | 315/39.51 |
| 5,635,797 | A | * | 6/1997 | Kitakaze et al. | 315/39.51 |

* cited by examiner

*Primary Examiner*—James Clinger
*Assistant Examiner*—Ephrem Alemu
(74) *Attorney, Agent, or Firm*—Darby & Darby

(57) ABSTRACT

A ring-shaped depressed groove 11 is formed between a joining surface 10 of a stem insulating material 6 with a tubular metal container 16 and a joining surface 9 with cathode leads 2*a* and 2*b*. A metallized layer 8, formed at joining surface 9 and joining surface 10, is separated from edges 12 and 13 of ring-shaped depressed groove 11. The resulting magnetron reliably prevents discharges generated between the joining surface of the stem insulating material, with the tubular metal container, and the joining surface, with the cathode leads.

8 Claims, 5 Drawing Sheets

MAGNETRON

BACKGROUND TO THE INVENTION

The present invention relates to a magnetron useful in, for example, a microwave oven or the like, to generate microwaves.

For example, as described in Japanese Laid Open Patent Publication 6-97595 (H01J23/04, H01J23/14), a conventional microwave oven magnetron has a cathode portion having the two ends of a coiled filament fastened onto a pair of end hats. Cathode leads formed from molybdenum (Mo) and the like are affixed to these end hats. These cathode leads extend to the exterior by passing via through holes of a ceramic stem. A tubular metal container is soldered with silver soldering, or the like, onto a metallized surface on the outer perimeter of this ceramic stem. A separately assembled anode part, which is not shown, is affixed to the tubular metal container. The cathode leads are sealed in an airtight manner to the metallized surface of the ceramic stem by a silver soldering material with a metal joining plate as the medium material.

With a magnetron of this construction, in general, the tubular metal container that is joined with the anode part has a ground potential. On the other hand, a negative high voltage of 4 kV, for example, is applied and operated on the cathode part, constructed from the filament and the cathode leads and the like. Therefore, a discharge can easily occur between the end of the tubular metal container, which is soldered onto the metallized surface on the perimeter of the ceramic stem, and the metal joining plate, which is used when soldering the cathode leads onto the ceramic stem. This is because these joining parts both have metallized surfaces, and the edges become rough. In addition, the silver soldering used in the air tight seal grows at the edges, and numerous needle-like protrusions are formed. These become needle-like electrodes and also narrow the spacing.

Particularly with a microwave oven using a leakage transformer, when the power is turned on without preheating the filament, in the initial stage where electrons are not being emitted from the filament, a no-load voltage of 8–10 kV is added to the magnetron. Discharge occurs at the metallized part having the airtight seal as described above. A surge voltage is induced, and the high voltage parts are destroyed.

In order to solve these problems, a ring-shaped depressed groove is formed between the metallized surface that joins to the tubular metal container and the metallized surface that joins to the cathode leads. By having the tubular metal container and the metal joining plate protrude over the upper surface of the ring-shaped depressed groove, the needle-like protrusions of the soldering material are electrically covered with an electric conductor, and a field-less layer is formed to prevent discharges.

However, with a construction with the above approach, because the tubular metal container and the metal joining plate protrude over the upper surface of the ring-shaped depressed groove, the shapes of the tubular metal container and the metal joining plate become larger, and the costs increase. In addition, because the space between the tubular metal container and the metal joining plate is narrowed, discharges is not completely prevented.

OBJECTS AND SUMMARY OF THE INVENTION

It is an object of the present invention to provide a magnetron which overcomes the foregoing problems.

It is a further object of the present invention to provide a magnetron that reliably prevents discharges generated between the joining surface of the stem insulating material with the tubular metal container and the joining surface with the cathode leads.

According to an embodiment of the present invention a magnetron comprises a tubular metal container, joined in an airtight manner with an anode part, constructing one section of a vacuum container. A stem insulating material has a perimeter which is joined in an airtight manner to an open end of the tubular metal container. A cathode has a filament positioned at a central axis of the anode part. A pair of cathode leads support the cathode and are affixed to a metal joining plate that is joined in an airtight manner to a central part of the stem insulating material. A ring-shaped depressed groove is formed between a joining surface of the stem insulating material with the tubular metal container and a joining surface with the cathode leads. A metallized layer, formed at the joining surface of the tubular metal container and the joining surface of the cathode lead, is positioned separated from the edge of the ring-shaped depressed groove. At least one or the other of the open end of the tubular metal container or the metal joining plate protrude towards the interior more than the metallized layer.

A magnetron having the above construction results in the metallized layer not being formed on the joining surface at the edge of the ring-shaped depressed groove. As a result, even if a silver soldering material, or the like, used in the air-tight seal, form needle-like protrusions at the edges of the metallized layer, the needle-like protrusions are not formed at the edge of the ring-shaped depressed groove. Therefore, without narrowing the space between the open end of the tubular metal container and the metal joining plate, the needle-like protrusions formed at the edges of the metallized layer can be electrically covered with a metal conductor to form a field-free layer. As a result, in the initial stage, before electrons are emitted from the cathode, even if a no-load voltage of 8–10 kV is applied on the cathode, discharge is reliably prevented.

In addition, the joining surface of the tubular metal container and the joining surface of the cathode leads are positioned preferably on the same plane. The metallized layer is formed preferably by pattern printing. As a result, because the edges of the ring-shaped depressed groove are on the same plane as the joining surfaces and can be easily excluded from the coating area, the metallized layer is formed without any decline in the coating operation.

According to another embodiment of the present invention, a magnetron, comprises a tubular metal container joined in an airtight manner with an anode part, constructing one section of a vacuum container. A stem insulating material has a perimeter which is joined in an airtight manner to an open end of the tubular metal container. A cathode has a filament positioned at a central axis of the anode part. A pair of cathode leads support the cathode and are affixed to a metal joining plate that is joined in an airtight manner to a central part of the stem insulating material. A ring-shaped depressed groove is formed between a joining surface of the stem insulating material with the tubular metal container and a joining surface with the cathode leads. A metallized layer is formed at the joining surfaces. A step part is lower than the joining surfaces being formed at the edge of the ring-shaped depressed groove.

A magnetron having the above construction has a step part which can stop the growth of the silver soldering material used for the air-tight seal. As a result, the needle-like protrusions are no longer formed at the edge of the ring-shaped depressed groove. Without narrowing the space between the open end of the tubular metal container and the metal joining plate, the needle-like protrusions can be electrically covered by a metal conductor ahead of the depressed groove, and a field-free layer is formed. As a result, in the initial stage before electrons are emitted from the cathode, even if a no-load voltage of 8–10 kV is applied on the cathode, discharge is reliably prevented.

In addition, the joining surface of the tubular metal container and the joining surface of the cathode leads are positioned preferably along the same plane. As a result, forming of the metallized layer, which is necessary for soldering to the joining surface and is formed by coating molybdenum (Mo) and manganese (Mn), can be conducted by a single screen coating. The production quality of the stem insulating material is improved.

The above, and other objects, features, and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
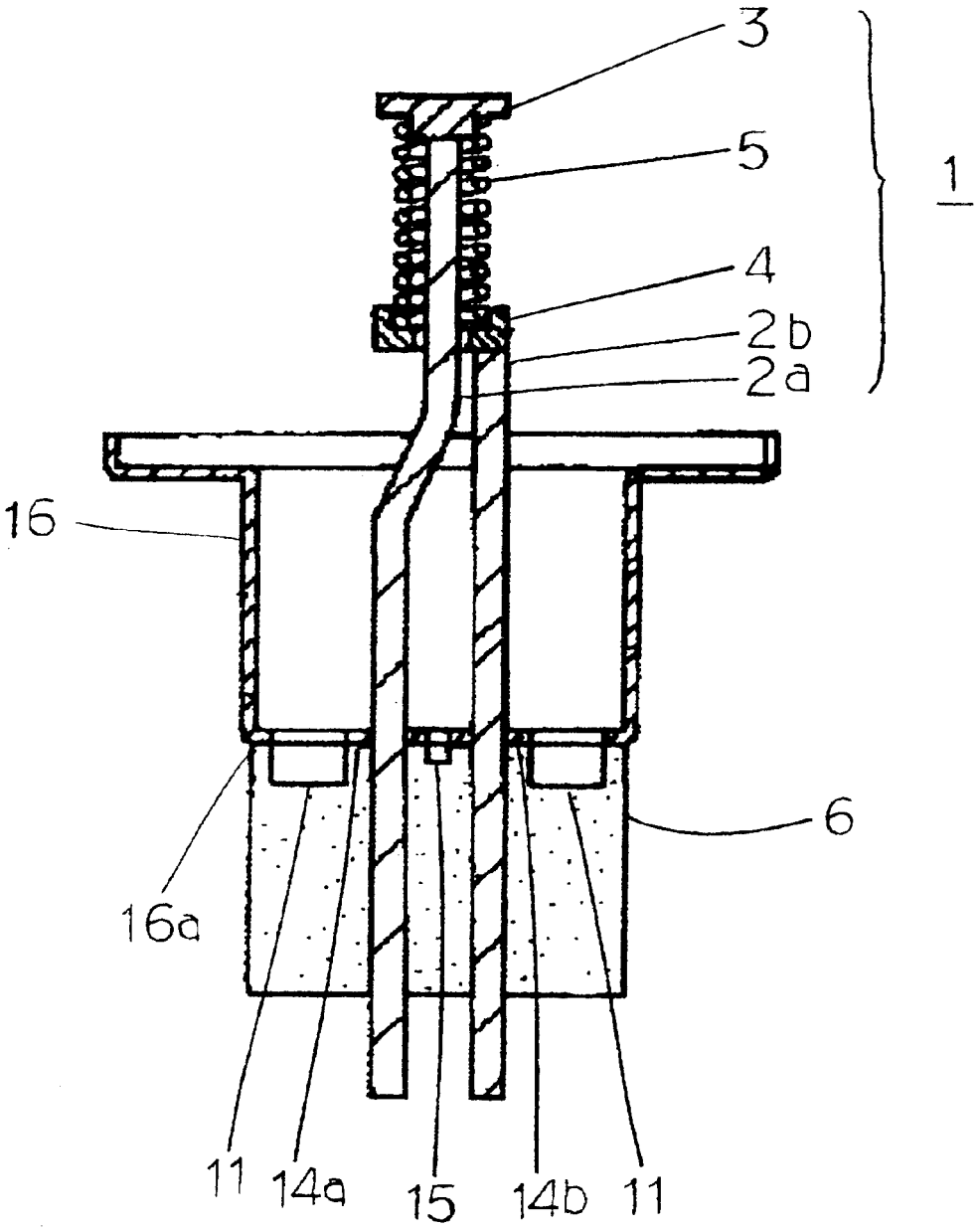
FIG. 1 is a longitudinal cross-section of the principle parts of a magnetron of a first embodiment of the present invention.

Referring to the drawings, a first embodiment of the present invention is described in detail.

Figure 2:
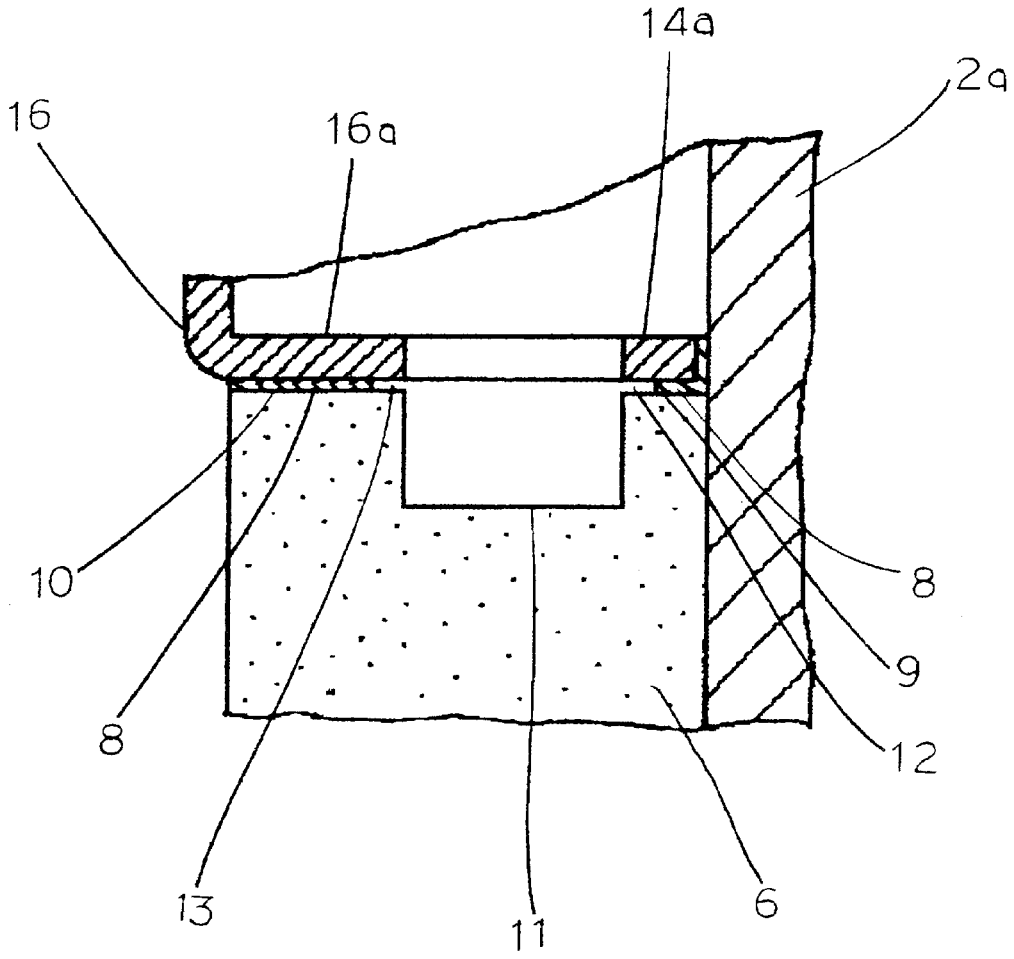
FIG. 2 is an enlarged view of FIG. 1.
Figure 3:
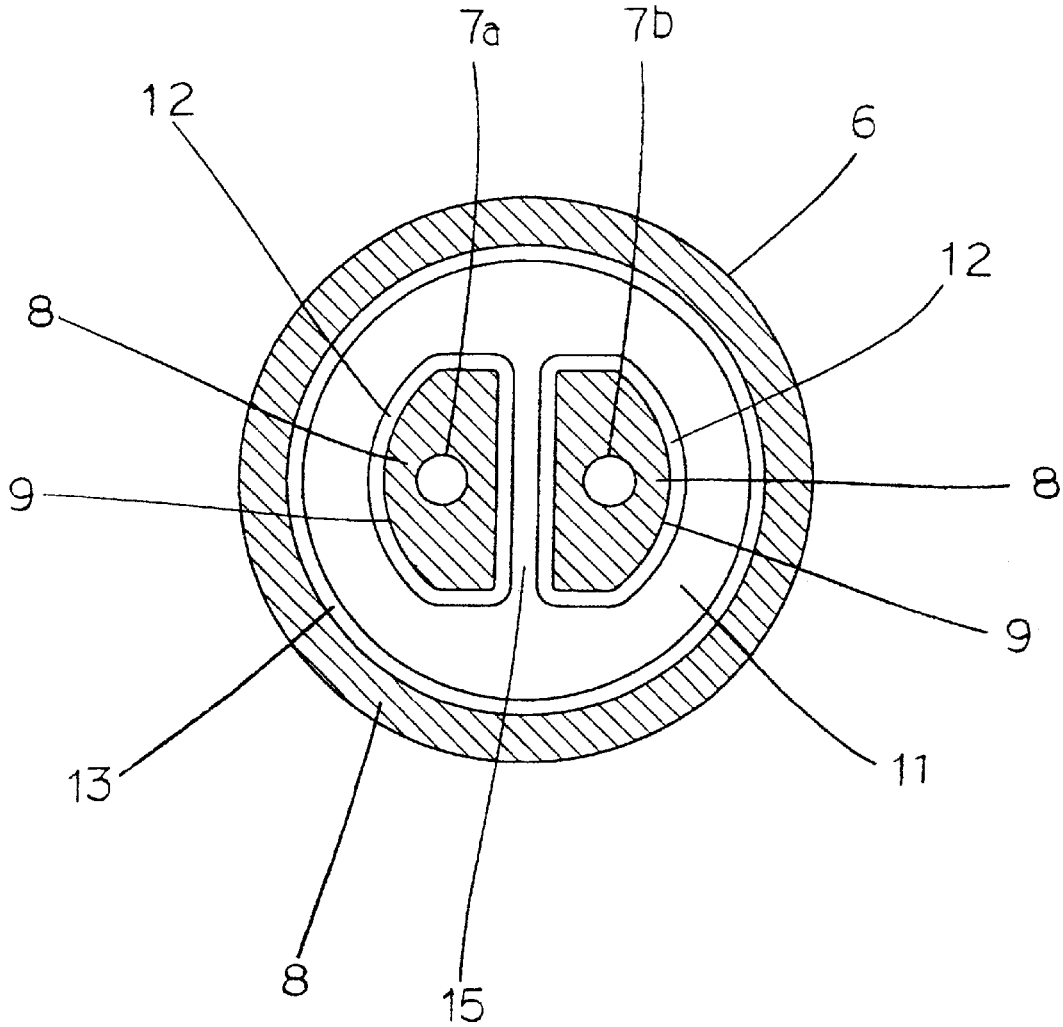
FIG. 3 is a plan view of a stem insulating material of the same.

Referring to FIGS. 1–3, a cathode 1 is constructed from a filament 5 sandwiched between a first and second cathode leads 2*a* and 2*b* via a top hat 3 and an end hat 4. By feeding cathode 1 from cathode leads 2*a* and 2*b*, thermoelectrons are emitted from filament 5.

A highly heat resistant stem insulation material 6 is made preferably of alumina, ceramic or the like. Cathode leads 2*a* and 2*b* are inserted through a pair of through holes 7*a* and 7*b*.

A metallized layer 8 is a coating of a paste of molybdenum (Mo) and manganese (Mn). Metallized layer 8 is formed on a joining surface 9, which joins with cathode leads 2*a* and 2*b*, and a joining surface 10, which joins with a tubular metal container 16, to be described later. Pattern printing can be conducted excluding edges 12 and 13 of a ring-shaped depressed groove 11, formed between joining surface 9 and joining surface 10. In addition, in order to improve the soldering, nickel plating (Ni) is conducted on the surface of metallized surface 8. Joining surface 9 and joining surface 10 are positioned on the same plane as stem insulating material 6.

Metal joining plates 14*a* and 14*b* are for anchoring cathode leads 2*a* and 2*b*. Metal joining plates 14*a* and 14*b* are electrically separated by a central groove 15. Metal joining plates 14*a* and 14*b* are joined by soldering, in an airtight manner, to joining surfaces 9 of cathode leads 2*a* and 2*b*. Joining surfaces 9 are formed at the edges of through holes 7*a* and 7*b*. In addition, metal joining plates 14*a* and 14*b* are joined protruding out towards ring-shaped depressed groove 11 more than metallized layer 8.

A tubular metal container 16 is joined, in an airtight manner, to an anode part (not shown) and constructs one part of a vacuum container. Open end 16*a* of tubular metal container 16 is joined, in an airtight manner, by soldering to joining surface 10. Joining surface 10 of tubular metal container 16 is formed on the surface outer perimeter of stem insulating material 6. In addition, open end 16*a* protrudes out towards cathode 1 more than metallized layer 8.

In the first embodiment, both the metal joining plate and the open end for the tubular metal container are made to protrude towards the interior more than the metallized layer. However, only one of either the metal container or the end of the tubular metal container needs to protrude towards the interior more than the metallized layer.

With the above construction, metallized layer 8 is not formed on edges 12 and 13 of ring-shaped depressed groove 11. As a result, even if needle-like protrusions, which are formed from silver soldering material used for the airtight seal, are formed on the edge of metallized layer 8, they are not formed on edges 12 and 13 of ring-shaped depressed groove 11. Therefore, a field-free layer is formed without narrowing the space between open end 16*a* of tubular metal container 16 and metal joining plates 14*a* and 14*b*. As a result, in the initial step, where electrons are not being emitted from cathode 1, even if a no-load voltage of 8–10 kV is applied on cathode 1, discharge is reliably prevented.

Furthermore, the paste of molybdenum (Mo) and manganese (Mn) is coated onto joining surface 9 and joining surface 10 by pattern printing in which the coating area can be setup. As a result, it is easy to conduct coating while omitting edges 12 and 13 that are on the same plane as joining surface 9 and joining surface 10.

Next, referring to the drawings, a second embodiment of the present invention will be described. The same structures as in the first embodiment are given the same numerals, and the descriptions are omitted.

Figure 4:
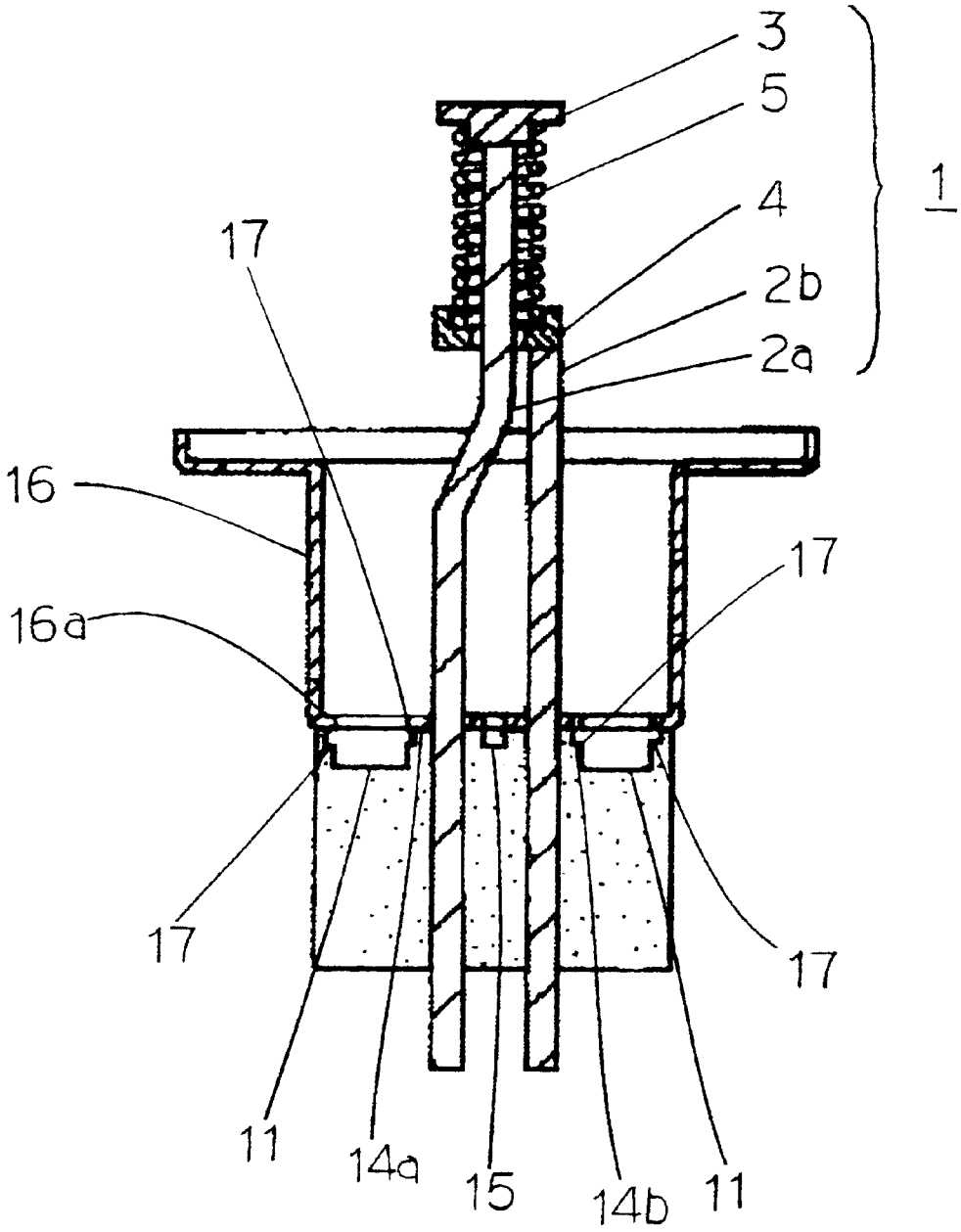
FIG. 4 is a longitudinal cross-section of the principle parts of a magnetron of a second embodiment of the present invention.
Figure 5:
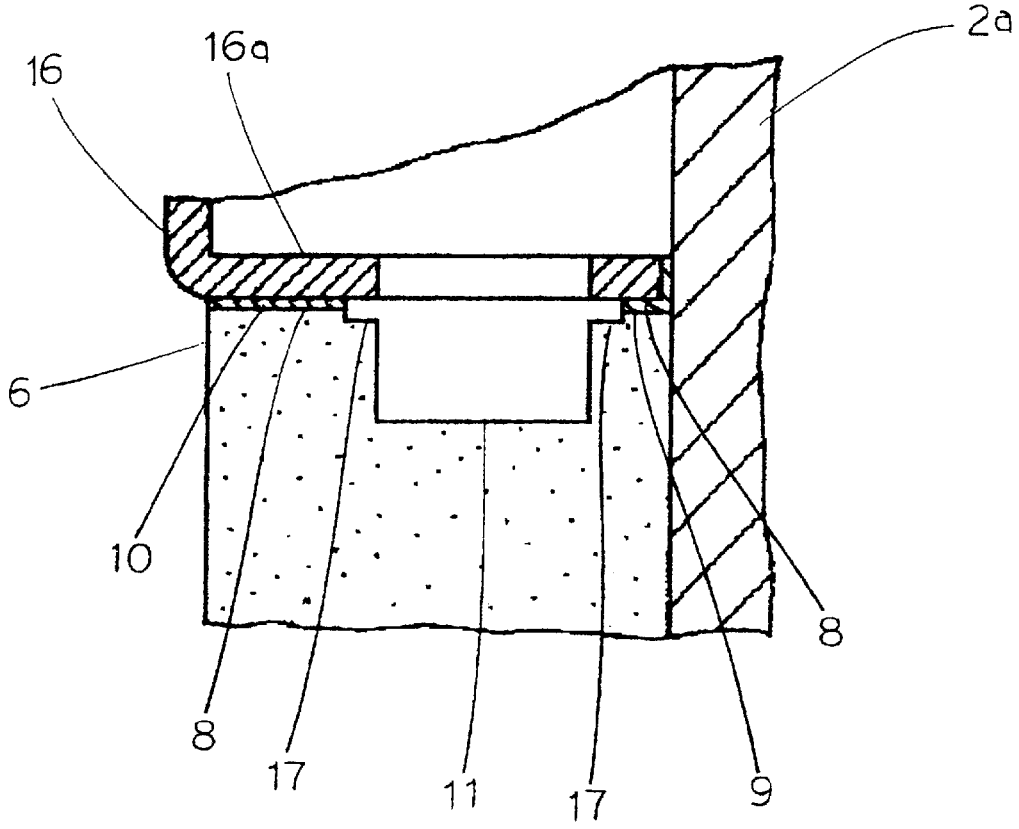
FIG. 5 is an enlarged view of FIG. 4.

Referring to FIGS. 4 and 5, a step 17 is formed at the edge of ring-shaped depressed groove 11. Metallized layer 8 is not formed on step 17.

With the above construction, because metallized layer 8 is not formed on step 17, the needle-like projections formed by the silver soldering material, and the like, used for the air-tight seal does not form at the edge of ring-shaped depressed groove 11. Therefore, a field free layer is formed without narrowing the space between open end 16*a* of tubular metal container 16 and metal joining plates 14*a* and 14*b*. As a result, in the initial stage where electrons are not being emitted from cathode 1, even when a no-load voltage of 8–10 kV is applied on cathode 1, discharge is reliably prevented.

Furthermore,joining surface 9 and joining surface 10 are positioned on the same plane of stem insulating material 6. As a result, metallized layer 8, which is necessary for soldering and is formed by coating molybdenum (Mo) and manganese (Mn), is formed by a one-time screen coating. This results in an improved quality of stem insulating material 6.

According to an embodiment of the present invention, a ring-shaped depressed groove is formed between a joining surface of the stem insulating material with the tubular metal container and a joining surface with the cathode leads. A metallized layer, which is formed at the joining surface of the tubular metal container and the joining surface of the cathode lead, is positioned separated from the edge of the ring-shaped depressed groove. At least one or the other of the open end of the tubular metal container or the metal joining plate protrudes towards the interior more than the metallized layer. As a result, without narrowing the space between the open end of the tubular metal container and the metal joining plate, the needle-like protrusions formed at the edges of the metallized layer are electrically covered with a metal conductor, and a field-free layer is formed. In the initial stage before electrons are emitted from the cathode, even if a no-load voltage of 8–10 kV is applied on the cathode, discharge is reliably prevented. Furthermore, because the metallized layer is formed over a smaller area, lesser amounts of molybdenum (Mo) and manganese (Mn), which are materials for the metallized layer, are used, and the material costs are reduced.

According to a feature of the present invention, the joining surface of the tubular metal container and the joining surface of the cathode leads are positioned on the same plane, and the metallized layer is formed by pattern printing. The edges of the ring-shaped depressed groove are on the same plane as the joining surfaces and can be easily excluded from the coating area. As a result, the metallized layer is formed without any decline in the coating operation.

According to another embodiment of the present invention, a ring-shaped depressed groove is formed between a joining surface of the stem insulating material with the tubular metal container and a joining surface with the cathode leads. A metallized layer is formed at the joining surfaces. A step part that is lower than the joining surfaces is formed at the edge of the ring-shaped depressed groove. The step part stops the growth of the silver soldering material used for the air-tight seal. As a result, the needle-like protrusions are no longer formed at the edge of the ring-shaped depressed groove. Without narrowing the space between the open end of the tubular metal container and the metal joining plate, the needle-like protrusions are electrically covered by a metal conductor ahead of the depressed groove, and a field-free layer is formed. Therefore, in the initial stage before electrons are emitted from the cathode, even if a no-load voltage of 8–10 kV is applied on the cathode, discharge is reliably prevented. In addition, because the metallized layer is formed over a smaller area, lesser amounts of molybdenum (Mo) and manganese (Mn), which are materials for the metallized layer, are used, and the material costs are reduced.

According to a feature of the present invention, the joining surface of the tubular metal container and the joining surface of the cathode leads are positioned along the same plane. As a result, forming of the metallized layer, which is necessary for soldering to the joining surface and is formed by coating molybdenum (Mo) and manganese (Mn), can be conducted by a one-time screen coating. The production quality of the stem insulating material is improved.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A magnetron, comprising:

a metal container, joined in an anode part, to construct one section of a vacuum container;

a stem insulating material whose perimeter is joined to an open end of said metal container;

a cathode in which a filament is positioned at substantially a central axis of said anode part;

first and second cathode leads, supporting said cathode, are affixed to a metal joining plate;

said metal joining plate located at a central part of said stem insulating material;

a ring-shaped depressed groove between a joining surface of said stem insulating material with said metal container and a joining surface with said cathode leads;

a metallized layer, located at said joining surface of said metal container and said joining surface of said cathode lead, positioned separated from an edge of said ring-shaped depressed groove; and at least one of said open end of said metal container and said metal joining plate protruding towards an interior of said magnetron more than said metallized layer.

2. The magnetron according to claim 1, wherein said metal container is a tubular metal container.

3. The magnetron according to claim 1, wherein:

said metal container is joined in said anode part in an airtight manner;

said perimeter of said stem insulating material is joined to said open end in an airtight manner; and said metal joining plate is joined to said central part of said stem insulating material in an airtight manner.

4. A magnetron as described in claim 1, wherein:

a joining surface of said metal container and a joining surface of said cathode leads are positioned on the same plane; and said metallized layer is formed by pattern printing.

5. A magnetron, comprising:

a metal container, having an anode part, constructing one section of a vacuum container;

a stem insulating material whose perimeter is joined to an open end of said metal container;

a cathode having a filament positioned at a substantially central axis of said anode part;

first and second cathode leads, supporting said cathode, are affixed to a metal joining plate;

said metal joining plate located at a central part of said stem insulating material;

a ring-shaped depressed groove between a first joining surface of said stem insulating material with said tubular metal container and a second joining surface with said cathode leads;

a metallized layer at said first and second joining surfaces; and a step part, lower than said first and second joining surfaces, is located at an edge of said ring-shaped depressed groove.

6. The magnetron according to claim 5, wherein said metal container is a tubular metal container.

7. The magnetron according to claim 5, wherein:

said metal container is joined in said anode part in an airtight manner;

said perimeter of said stem insulating material is joined to said open end in an airtight manner; and said metal joining plate is joined to said central part of said stem insulating material in an airtight manner.

8. A magnetron as described in claim 5, wherein:

said first joining surface and second said joining surface are positioned along the same plane.

* * * * *